US008899742B2

(12) United States Patent
Samoto et al.

(10) Patent No.: US 8,899,742 B2
(45) Date of Patent: Dec. 2, 2014

(54) IMAGE RECORDING APPARATUS

(71) Applicants: Kenji Samoto, Nagoya (JP); Tsuyoshi Ito, Nagoya (JP); Takashi Omura, Nagoya (JP)

(72) Inventors: Kenji Samoto, Nagoya (JP); Tsuyoshi Ito, Nagoya (JP); Takashi Omura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/853,155

(22) Filed: Mar. 29, 2013

(65) Prior Publication Data

US 2013/0286127 A1 Oct. 31, 2013

(30) Foreign Application Priority Data

Apr. 27, 2012 (JP) ..... 2012-104097

(51) Int. Cl.

| | |
|---|---|
| ***B41J 2/01*** | (2006.01) |
| ***B41J 13/10*** | (2006.01) |
| ***B41J 13/02*** | (2006.01) |
| ***B41J 11/00*** | (2006.01) |

(52) U.S. Cl.

CPC ..... *B41J 11/007* (2013.01); *B41J 13/10* (2013.01); *B41J 13/02* (2013.01); *B41J 11/006* (2013.01)

USPC ..... 347/104

(58) Field of Classification Search

None

See application file for complete search history.

(56) References Cited

FOREIGN PATENT DOCUMENTS

| | | | |
|---|---|---|---|
| JP | 50-43110 | A | 2/1993 |
| JP | 10-071711 | A | 3/1998 |
| JP | 2000-071532 | A | 3/2000 |

*Primary Examiner* — Geoffrey Mruk
*Assistant Examiner* — Bradley Thies
(74) *Attorney, Agent, or Firm* — Banner & Witcoff, Ltd.

(57) ABSTRACT

An image recording device may include corrugate mechanisms to prevent undesired bending and jamming of a recording sheet. In some examples, the image recording device may include a first corrugate mechanism, a second corrugate mechanism and a third corrugate mechanism. The first, second and third corrugate mechanisms may be configured to create a corrugated shape in a recording sheet. The second and third corrugate mechanisms, in one or more arrangements, may be located downstream of the first corrugate mechanism and an ink nozzle. The third corrugate mechanism may further be configured such that no upper contact portion thereof may be disposed at a same position, with respect to the width direction, as endmost upper contact portions of the first corrugate mechanism with respect to the width direction. In yet other examples, the third corrugate mechanism may be located downstream of a reverse sheet conveying path.

13 Claims, 9 Drawing Sheets

IMAGE RECORDING APPARATUS

CROSS-REFERENCE TO RELATED APPLICATIONS

This application claims priority from Japanese Patent Application No. 2012-104097, filed on Apr. 27, 2012, which is incorporated herein by reference in its entirety.

TECHNICAL FIELD

Aspects described herein relate to an image recording apparatus that records an image onto a sheet while conveying the sheet maintained in a specified shape.

BACKGROUND

A known image recording apparatus is configured to convey a sheet by a conveyor roller pair while holding the sheet by a platen, record an image onto the sheet held by the platen by ejecting ink droplets from a recording head, and discharge the sheet having the recorded image by a discharge roller pair.

The known image recording apparatus includes a plurality of ribs disposed on the platen, a recording-sheet pressing plate, and a plurality of spurs. The recording sheet-pressing plate is disposed between the conveyor roller pair (including a sheet-feed drive roller and a registration roller) and the recording head with respect to a conveying direction. The plurality of spurs are disposed between the recording head and the discharge roller pair (including a sheet-discharge drive roller and sheet discharge spurs) with respect to the conveying direction.

The plurality of ribs extend parallel to the conveying direction and define grooves therebetween. The recording-sheet pressing plate includes a plurality of protrusions that protrude toward the respective grooves. The plurality of spurs are located in the respective grooves. While the sheet passes between the ribs and the protrusions, the sheet is pressed by the ribs and the protrusions in opposite directions. Therefore, the sheet is formed into a corrugated shape such that the sheet has ridge portions that are held by the ribs and groove portions that are depressed by the protrusions. The corrugated sheet is conveyed while the ridge portions are held by the ribs of the platen, respectively. After the sheet passes the platen, the groove portions of the sheet are depressed by the spurs.

SUMMARY

In the known image recording apparatus, the recording head may continue to eject ink droplets after a trailing edge of the sheet passes the conveyor roller pair with respect to the conveying direction. Therefore, the known image recording apparatus may need to be provided with pressing members (e.g., the plurality of spurs) that press the sheet to maintain the sheet in the corrugated shape after the trailing edge of the sheet passes the conveyor roller pair. However, when the corrugated sheet contacts a sheet discharge tray, both ends of the corrugated sheet with respect to a width direction orthogonal to the conveying direction may be caught on the sheet discharge tray, and thus, a paper jam may occur. In addition, the corrugated sheet may push one or more sheets that are held on the sheet discharge tray out of the sheet discharge tray.

Accordingly, aspects described herein provide for an image recording apparatus for recording an image on a corrugated sheet, and a configuration that may prevent or reduce an occurrence of a paper jam and falling or bending of a sheet (e.g., held on a sheet discharge tray). In one example, the image recording apparatus may include a first corrugate mechanism, a second corrugate mechanism and a third corrugate mechanism. The second and third corrugate mechanisms may be disposed downstream from nozzles of a recording device of the image recording apparatus. In some arrangements, a corrugate mechanism (e.g., the third corrugate mechanism) may be disposed downstream of a reverse conveying path of the image recording apparatus.

According to the one or more aspects, no upper contact portion of the third corrugate mechanism might be disposed at a position corresponding to the endmost first upper contact portions of the first corrugate mechanism with respect to the width direction. Therefore, groove portions of side edges of the corrugated sheet in the width direction are not depressed by the third contact portion. Accordingly, in some examples, an occurrence of the side edges of the corrugated sheet being caught on a holding surface of the sheet discharge tray and/or the discharged corrugated sheet pushing one or more sheets held on the sheet discharge tray out of the sheet discharge tray may be reduced.

DESCRIPTION OF THE DRAWINGS

For a more complete understanding of the present disclosure, needs satisfied thereby, and the objects, features, and advantages thereof, reference now is made to the following descriptions taken in connection with the accompanying drawing.

DETAILED DESCRIPTION

An illustrative embodiment according to one or more aspects is described below with reference to the accompanying drawings. The illustrative embodiment described below is only example. Various changes, arrangements and modifications may be applied therein without departing from the spirit and scope of the disclosure.

Figure 1:
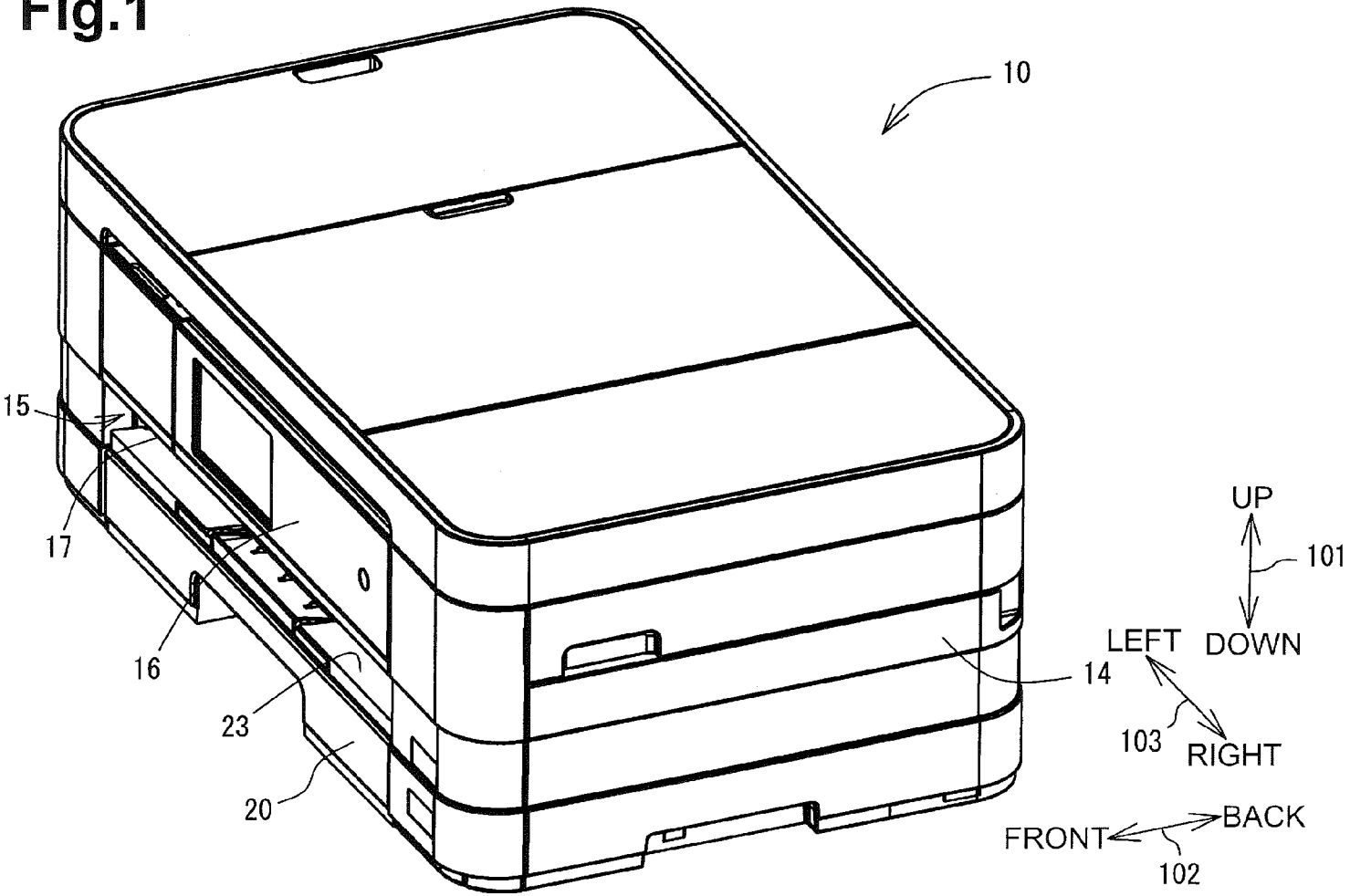
FIG. 1 is a perspective view depicting an appearance of an image recording apparatus in an illustrative embodiment according to one or more aspects of the disclosure.

As depicted in FIG. 1, an image recording apparatus 10 may comprise a printer unit 11 and a scanner unit 12. The printer unit 11 may be configured to record an image onto a sheet 100. The scanner unit 12 may be configured to scan an image recorded on a document. The image recording apparatus 10 may be configured to perform one or more of printing, scanning, and copying. In some examples, I image recording apparatus 10 might not necessarily comprise the scanner unit 12, whose detailed description is omitted. An up-down direction 101 may be defined with reference to an orientation of the image recording apparatus 10 in which it may be intended to be used. A side of the image recording apparatus 10, in which a display panel 16 may be disposed, may be defined as the front of the image recording apparatus 10. A front-rear direction 102 may be defined with reference to the front of the recording apparatus 10. A right-left direction 103 may be defined with respect to the image recording apparatus 10 as viewed from its front.

As depicted in FIG. 1, a housing 14 may have a substantially rectangular parallelepiped shape. The display panel 16 may be disposed on an upper part of the front of the housing 14. The housing 14 may have an opening 15 below the display panel 16. A sheet feed tray 20 may be configured to be attached to the inkjet recording apparatus 10 via the opening 15. The display panel 16 may have a rectangular plate-like shape elongated in the right-left direction 103. The display panel 16 may comprise a support shaft (not depicted) on both sides of an upper end of the display panel 16 in the right-left direction 103. The support shaft may be rotatably supported by the housing 14. Therefore, the display panel 16 may be configured to pivot about an axis of the support shaft extending along the right-left direction 103 at the upper end while a lower end of the display panel 16 may be a moving end. A grip portion 17 may be disposed on a left lower end of the display panel 16 to allow a user to pivot the display panel 16 by pinching the grip portion 17, as viewed from the front of the display panel 16.

As depicted in FIG. 1, the sheet feed tray 20 may be disposed in a lower part of the housing 14. The sheet feed tray 20 may be configured to be pulled out toward the front with respect to the housing 14. The sheet feed tray 20 may be configured to accommodate one or more stacked sheets 100 subject to image recording. The sheet feed tray 20 may be configured to accommodate one or more sheets 100 of various sizes and types.

Figure 2:
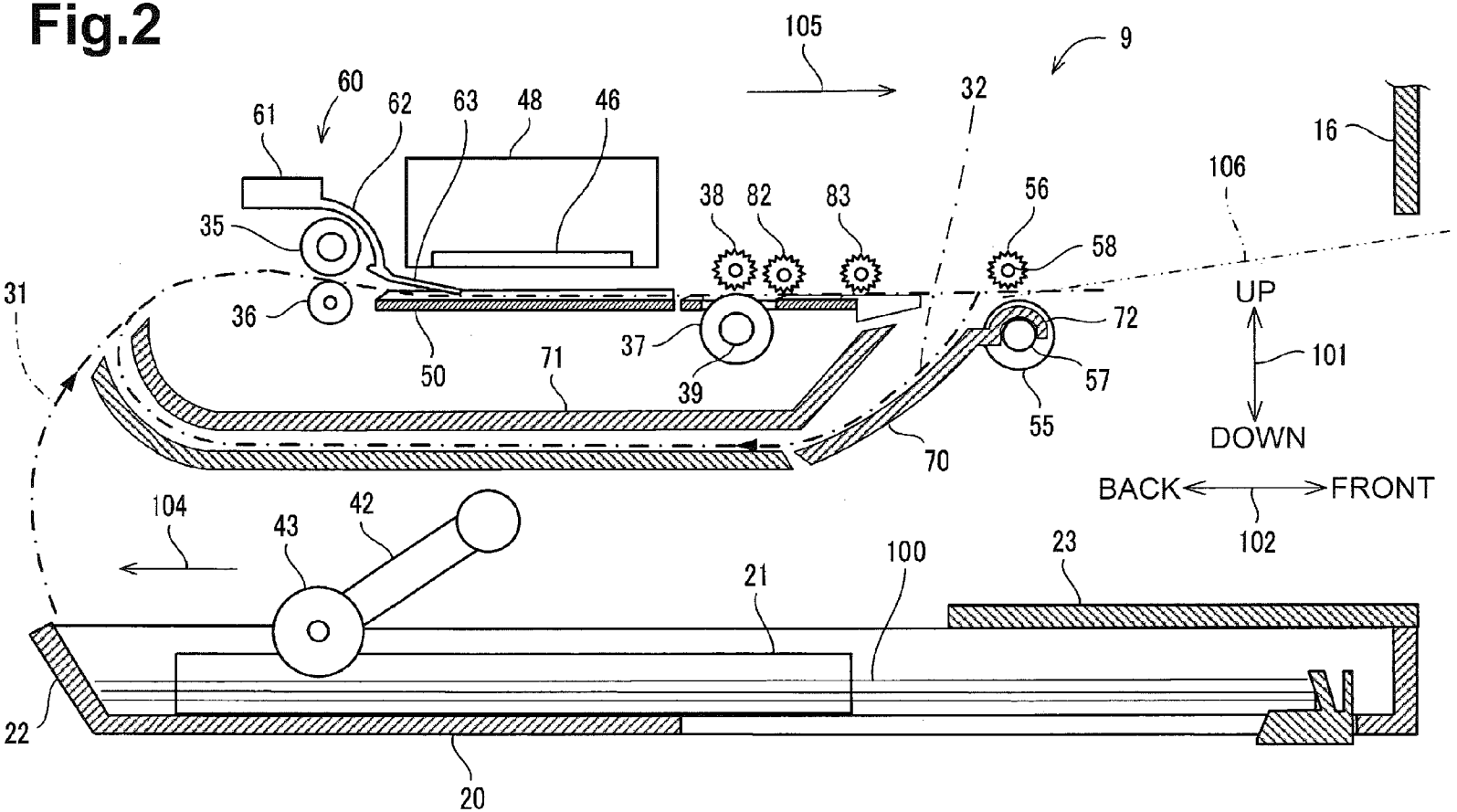
FIG. 2 is a schematic longitudinal sectional view depicting an internal structure of a printer unit in the illustrative embodiment according to one or more aspects of the disclosure.

As depicted in FIG. 2, a guide member 21 may be disposed in the sheet feed tray 20. The guide member 21 may be configured to move in accordance with the size of the one or more sheets 100 placed on the sheet feed tray 20. Both side edges of the one or more sheets 100 with respect to the right-left direction 103 and upstream edges (e.g., a rear edge) of the one or more sheets 100 with respect to a sheet feeding direction 104 may be positioned by the guide member 21.

An inclined wall 22 may be disposed on a rear end of the sheet feed tray 20. The inclined wall 22 may be extend obliquely upward in the sheet feed direction 104. The inclined wall 22 may have substantially the same width as a width of the sheet feed tray 20 in the right-left direction 103. When a sheet 100 is fed from the sheet feed tray 20 in the sheet feed direction 104, a leading edge of the sheet 100 may come into contact with the inclined wall 21 and then may be directed upward. As a result, the sheet 100 may enter a first conveying path 31.

As depicted in FIG. 2, a feed roller 43 may be disposed above the sheet feed tray 20. The feed roller 43 may be configured to rotate about an axis extending along the right-left direction 103. The feed roller 43 may be rotatably supported by one end of an arm 42 that may extend obliquely downward while the other end of the arm 42 serves as a rotation shaft. The arm 42 may be configured to pivot such that the one end thereof may move in the up-down direction 101. The feed roller 43 may be configured to move in the up-down direction 101 while changing a distance between the feed roller 43 and the sheet feed tray 20, in accordance with the pivot of the arm 42. The arm 42 may pivot downward by its own weight. Therefore, the feed roller 43 may be in contact with an uppermost sheet 100 of the plurality of sheets 100 accommodated in the sheet feed tray 20. The feed roller 43 may be configured to be rotated by transmission of a drive force from a motor (not depicted). As the feed roller 43 is rotated, the uppermost sheet 100 that may be in contact with the feed roller 43 may be fed in the sheet feed direction 104.

As depicted in FIG. 2, the first conveying path 31 through which a sheet 100 may be conveyed may be defined inside the housing 14. The first conveying path 31 may be curved upward from an upper end of the inclined wall 22 and extend toward the front from the rear of the image forming apparatus 10. The first conveying path 31 may be defined by a pair of guide members (not depicted) that may face each other while allowing a space therebetween for a sheet 100 to pass therethrough.

As depicted in FIG. 2, a second conveying path 32 may be defined inside the housing 14. The second conveying path 32 may be used to convey a sheet 100 in double-sided printing. The second conveying path 32 may extend from a position that may be located between a first discharge roller 37 and a second discharge roller 55 in the first conveying path 31 to a position in a curved section of the first conveying path 31 that may be located upstream of a conveyor roller 35 with respect to the conveying direction 105. The second conveying path 32 may be defined by defining members 70, 71 that may face each other while allowing a space therebetween for a sheet 100 to pass therethrough.

As depicted in FIG. 2, the conveyor roller 35 and following rollers 36 may be disposed downstream of the U-shaped curved section of the first conveying path 31 with respect to the conveying direction 105. The conveyor roller 35 may be disposed above the following rollers 36. The conveyor roller 35 and the following rollers 36 may be a roller pair.

Figure 3:
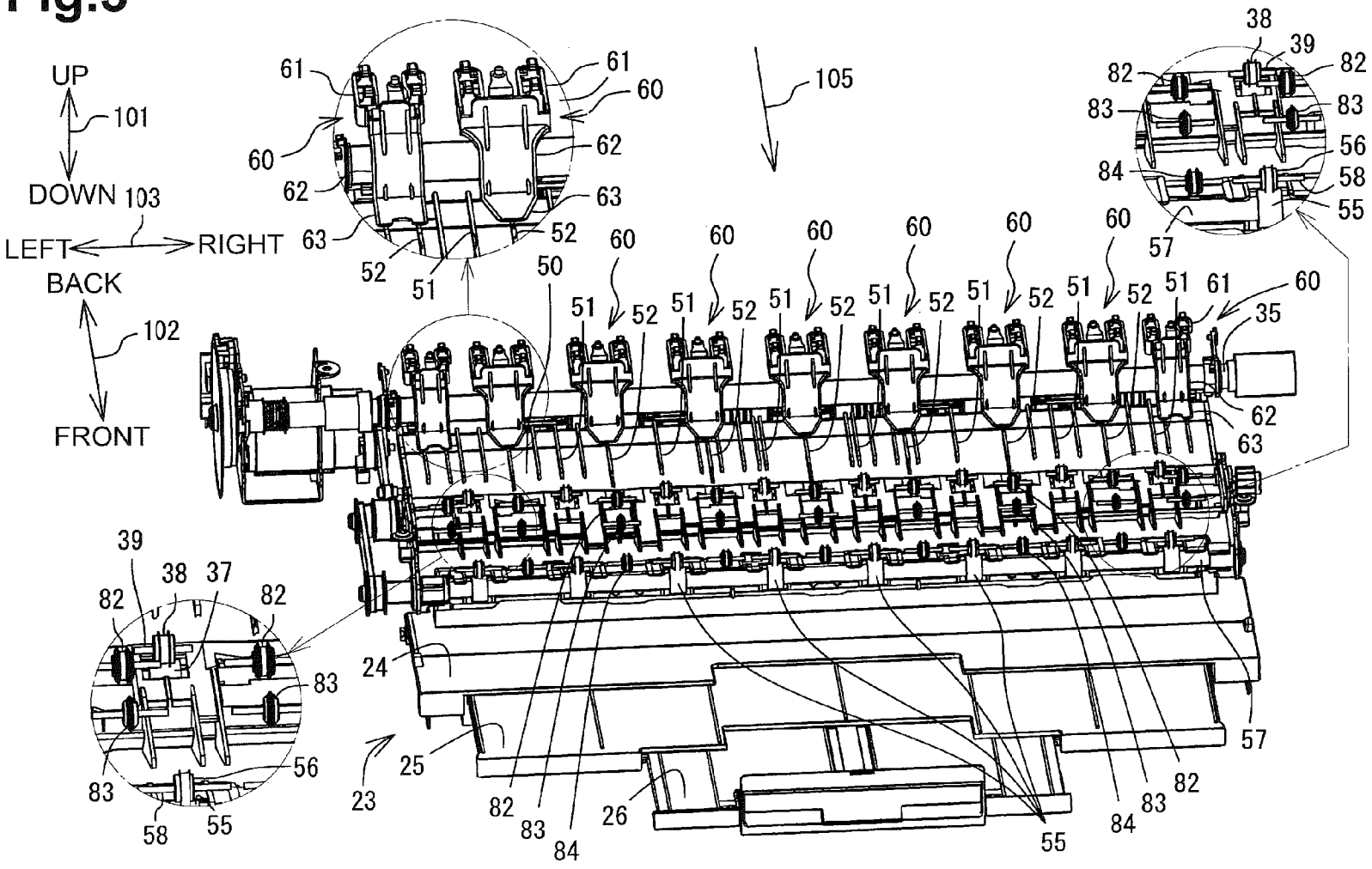
FIG. 3 is a perspective view depicting a portion in the vicinity of a platen in the illustrative embodiment according to one or more aspects of the disclosure.

As depicted in FIG. 3, the conveyor roller 35 may be a single roller that may extend in the right-left direction 103. The conveyor roller 35 may be configured to be rotated by transmission of a drive force from the motor.

As depicted in FIG. 2, the following rollers 36 may be disposed below the conveyor roller 35. The following rollers 36 may be configured to move substantially in the up-down direction 101. The following rollers 36 may be spaced apart from each other in the right-left direction 103. The following rollers 36 may be urged toward the conveyor roller 35 by an urging member such as a spring (not depicted). Therefore, a roller surface of each following roller 36 may be in contact with a roller surface of the conveyor roller 35. When a sheet 100 enters between the conveyor roller 35 and the following rollers 36, the following rollers 36 may be moved downward by the thickness of the sheet 100 against an urging force of the spring. Then, the sheet 100 may be nipped by the conveyor roller 35 and the following rollers 36. In this state, when the conveyor roller 35 rotates, the sheet 100 may be conveyed in the conveying direction 105 in accordance with the rotation of the conveyor roller 35.

As depicted in FIG. 2, a platen 50 may be disposed downstream of the conveyor roller 35 in the first conveying path 31 with respect to the conveying direction 105 and in the first conveying path 31 that may extend toward the front from the rear of the image recording apparatus 10. The platen 50 may define a part of a lower side of the first conveying path 31.

As depicted in FIG. 3, the platen 50 may have a plate-like shape that may extend in the right-left direction 103. The platen 50 may be configured to hold a sheet 100 by its upper surface. The platen 50 may comprise a plurality of first ribs 51 and a plurality of second ribs 52. The first ribs 51 and the second ribs 52 may be disposed on the upper surface of the platen 50. The first ribs 51 and the second ribs 52 may be spaced apart from each other in the right-left direction 103.

The first ribs 51 and the second ribs 52 may extend linearly along the conveying direction 105 across the upper surface of the platen 50. The first ribs 51 and the second ribs 52 may be spaced apart from each other in the right-left direction 103. The first ribs 51 may have a different function with respect to the sheet 100 than the second ribs 52. Therefore, the locations of the first ribs 51 and the second ribs 52 on the upper surface of the platen 50 may be determined according to their respective functions.

The first ribs 51 may be configured to hold the sheet 100 by their upper ends. The second ribs 52 may prevent the sheet 100 from contacting the upper surface of the platen 50 when the sheet 100 moves toward the platen 50 as a result of swelling of the sheet 100 due to ink adhered to the sheet 100. Therefore, the upper ends of the first ribs 51 may be located at a different level from upper ends of the second ribs 52 with respect to the up-down direction 101. The upper ends of the first ribs 51 may be located higher than the upper ends of the second ribs 52 with respect to the up-down direction 101.

The first ribs 51 may be disposed at respective positions in each of which a contact member 60 might not be disposed in the right-left direction 103. The second ribs 52 may be disposed at respective positions in each of which a contact member 60 may be disposed in the right-left direction 103. The first ribs 51 and the second ribs 52 might not need to be disposed alternately in the right-left direction 103. For example, the upper ends of first ribs 51 may be located at respective different levels as long as the upper ends of the first ribs 51 are located higher than the upper ends of the second ribs 52 in the up-down direction 101. In this embodiment, the sheet 100 may be conveyed in a state where the center line of the sheet 100 in the right-left direction 103 may be aligned with the center line of the platen 50 in the right-left direction 103. Therefore, both of the first ribs 51 and the second ribs 52 may be symmetrically disposed about the center line of the platen 50 in the right-left direction 103.

As depicted in FIG. 2, a carriage 48 may be disposed above the platen 50 while defining the first conveying path 31 therebetween. The carriage 48 may be supported by a guide rail (not depicted) and may be configured to move in the right-left direction 103 along the guide rail. The carriage 48 may be configured to move in the right-left direction 103 by transmission of a drive force from a motor (not depicted).

Figure 4:
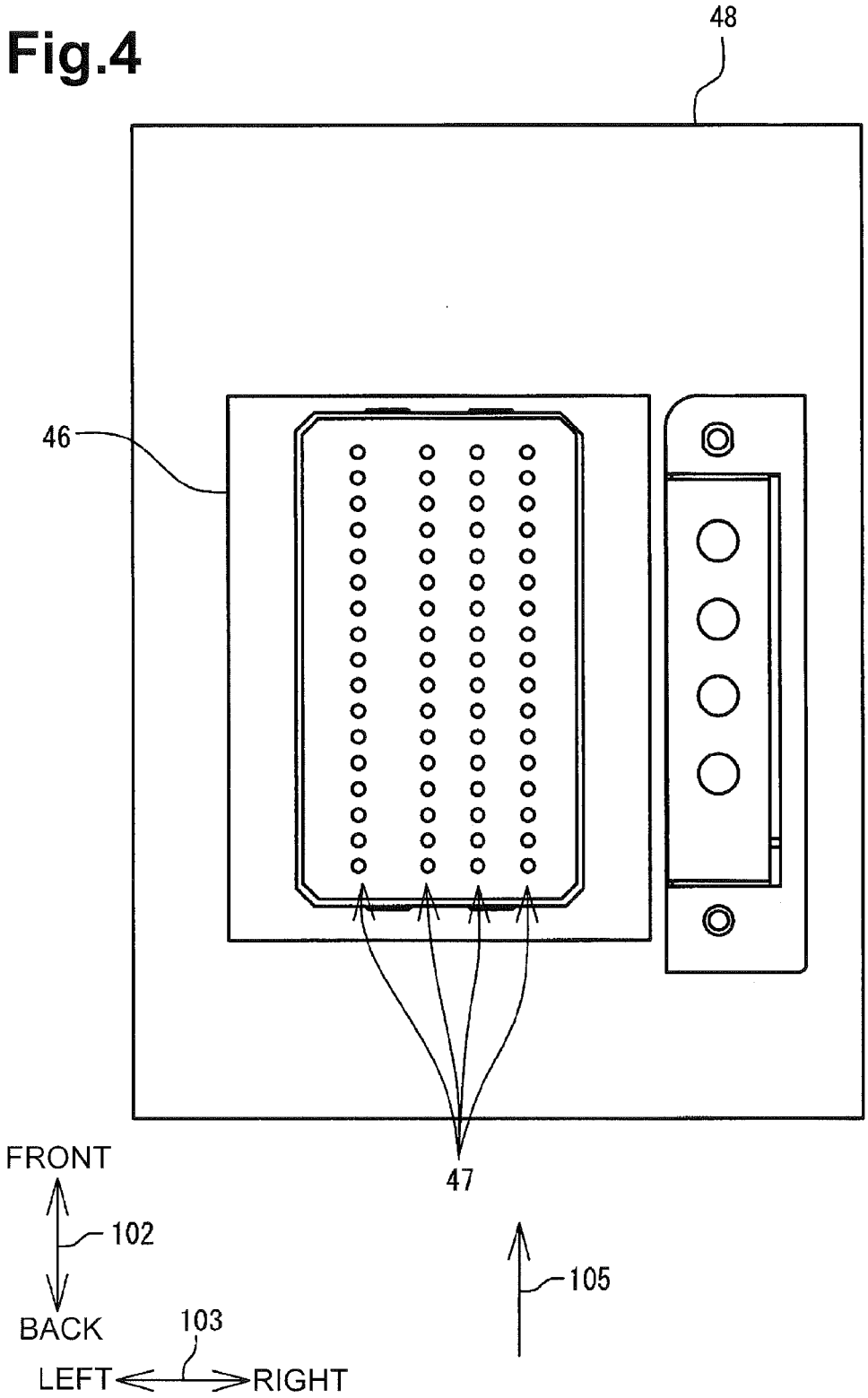
FIG. 4 is a bottom view depicting a recording head in the illustrative embodiment according to one or more aspects of the disclosure.

As depicted in FIG. 4, a recording head 46 may be mounted on the carriage 48. The recording head 46 may be exposed in a lower surface of the carriage 48. The recording head 46 may have a plurality of nozzles 47 arranged in rows extending along the front-rear direction 101 (e.g., the conveying direction 150). The nozzle rows may be provided for respective colors of ink and may be arranged side by side in the right-left direction 103. Each nozzle 47 may be opened in a lower surface of the recording head 47 and configured to eject an ink droplet therefrom by vibration of a piezoelectric element and boiling of ink.

While the recording head 46 moves in the right-left direction 103 in accordance with the movement of the carriage 48, the recording head 46 may eject ink droplets selectively from the nozzles 47. The ejected ink droplets may land on the sheet 100 held by the platen 50, and thus, an image may be recorded on the sheet 100.

As depicted in FIGS. 2 and 3, the contact members 60 may be disposed near an upstream end of the platen 50 and downstream of the conveyor roller 35 in the conveying direction 105. The contact members 60 may be spaced apart from each other in the right-left direction 103. The contact members 60 may correspond to first upper contact portions.

A structure of the contact members 60 is now described below. In one or more examples, all of the contact members 60 may have the same configuration, and therefore, the description of one of the contact member 60 may apply to a remainder of the contact members 60. The contact member 60 may comprise a fixing portion 61, a curved portion 62, and a contact portion 63. The fixing portion 61 may be configured to be fixed to the guide rail for supporting the carriage 48. The curved portion 62 may extend obliquely downward from the fixing portion 61 along the conveying direction 105. A tip of the curved portion 62 may be located close to the vicinity of the upstream end of the platen 50. The contact portion 63 may be configured to elastically deform upward because the contact member 60 may be made of, for example, synthetic resin.

The contact portion 63 may extend substantially parallel to the upper end of the second rib 52 of the platen 50 from an end of the curved portion 62 along the conveying direction 105. The width of the contact portion 63 in the right-left direction 103 may be greater than the width of the second rib 52. The contact portion 63 may have a plate-like shape and both ends of the contact portion 63 in the right-left direction 103 might not contact the first ribs 51 disposed on each side of the second rib 52 that the contact portion 63 may face. The contact portions 63 other than both endmost contact portions 63 in the right-left direction 105 may taper in a downstream conveying direction 105.

The contact portion 63 may face a part of an upstream part of the second rib 52 in the conveying direction 105. A lower surface of the contact portion 63 may be located higher than the upper end of the second rib 52 in the up-down direction 101 and may be located close to the upper ends of one second rib 52. In addition, the lower surface of the contact portion 63 may be located lower than the upper end of the first rib 51 in the up-down direction 101. Therefore, the lower surface of the contact portion 63 may be located closer to the upper surface of the platen 50 than the upper end of the first rib 51.

As depicted in FIGS. 2 and 3, a plurality of first discharge rollers 37 and a plurality of spurs 38 may be disposed downstream of the platen 50 in the first conveying path 31 with respect to the conveying direction 105. The first discharge rollers 37 may be disposed above the spurs 38, respectively. One of the first discharge rollers 37 and a corresponding one of the spurs 38 may be a roller pair.

The first discharge rollers 37 may be disposed on a rotational shaft 39. The rotational shaft 39 may extend along the right-left direction 103. The rotational shaft 39 may be configured to be rotated by transmission of a drive force from the motor (not depicted). The first discharge rollers 37 may be spaced apart from each other in the right-left direction 103. The first discharge rollers 37 may be configured to be rotated simultaneously by rotation of the shaft 39. The first discharge rollers 37 may be disposed at respective positions corresponding to the respective first ribs 51 with respect to right-left direction 103.

The spurs 38 may be disposed above the respective first discharge rollers 37. The spurs 38 may be configured to move in substantially the up-down direction 101. The spurs 38 may be spaced apart from each other in the right-left direction 103. Each spur 38 may be disposed on a shaft (not depicted) that may extend along the right-left direction 103. For example, the shaft of the spur 38 may be a coil spring. The spurs 38 may be supported by the coil springs, respectively, while being in contact with roller surfaces of the first discharge rollers 37, respectively. When a sheet 100 enters between the first discharge rollers 37 and the spurs 38, the spurs 38 may be moved while elastically deforming their shafts upward by the thickness of the sheet 100. Therefore, the sheet 100 may be nipped by the first discharge rollers 37 and the spurs 38. In this state, as the first discharge rollers 37 rotate, the sheet 100 may be conveyed in the conveying direction 105 in accordance with the rotation of the first discharge rollers 37. A contact point of each pair of first discharge roller 37 and spur 38 may be located at the same or substantially the same level as the upper ends of the first ribs 51 with respect to the up-down direction 101.

As depicted in FIGS. 2 and 3, the spurs 82 and the spurs 83 may be disposed downstream of the first discharge roller 37 in first conveying path 31 with respect to the conveying direction 105. One of spurs 82 and one of spurs 83 may be arranged in each row in the conveying direction 105. The rows each including one of spurs 82 and one of spurs 83 may be arranged along the right-left direction 103 and located at respective positions corresponding to the respective contact members 60. The spurs 82 and the spurs 83 may correspond to second upper contact portions.

The spurs 82 and the spurs 83 may be configured to move in substantially the up-down direction 101. Each of the spurs 82, 83 may be disposed on a shaft (not depicted) that may extend along the right-left direction 103. For example, the shaft of each of the spurs 82, 83 may be a coil spring. With this configuration, each of the spurs 82, 83 may be configured to move in the up-down direction 101 by an amount of elastic deformation of the corresponding coil spring. Lowest ends of the spurs 82, 83 may be located at the same or substantially the same positions as the lower surfaces of the contact portions 63 of the corresponding contact portions 60, respectively, in the up-down direction 101. For example, projecting ends of the spurs 82, 83 projecting toward the first conveying path 31 may be located closer to the platen 50 than the roller surface of the first discharge rollers 37 projecting toward the first conveying path 31.

As depicted in FIGS. 2 and 3, a plurality of second discharge rollers 55 and a plurality of spurs 56 may be disposed downstream of the spurs 83 in the first conveying path 31 with respect to the conveying direction 105. The second discharge rollers 55 may be disposed below the respective spurs 56. The second discharge rollers 55 and the spurs 56 may be a roller pair.

The second discharge rollers 55 may be disposed on a rotational shaft 57. The rotational shaft 57 may extend along the right-left direction 103. The rotating shaft 57 may be configured to be rotated by transmission of a drive force from the motor (not depicted). The second discharge rollers 55 may be spaced apart from each other in the right-left direction 103. The second discharge rollers 55 may be configured to be rotated simultaneously by rotation of the shaft 57. The second discharge rollers 55 may be disposed at respective positions corresponding to the respective first ribs 51 with respect to the right-left direction 103.

The spurs 56 may be disposed above the respective second discharge rollers 55. The spurs 56 may be configured to move in the up-down direction 101. The spurs 56 may be spaced apart from each other in the right-left direction 103. Each of the spurs 56 may be disposed on a shaft 58 that may extend along the right-left direction 103. For example, the shaft of each of the spurs 56 may be a coil spring. The spurs 56 may be supported by the respective shafts 58 in a state where the spurs 56 may be in contact with the roller surfaces of the second discharge rollers 55, respectively. Axes of the shafts 58 may be located upstream of an axis of each shaft 57 of the second discharge rollers 55 in the conveying direction 105.

When a sheet 100 enters between the second discharge rollers 55 and the spurs 56, the spurs 56 may be moved by the thickness of the sheet 100 while elastically deforming their shafts 58 upward. Therefore, the sheet 100 may be nipped by the second discharge rollers 55 and the spurs 56. In this state, as the first discharge rollers 55 rotate, the sheet 100 may be conveyed in the conveying direction 105 by the rotation of the first discharge rollers 55. A contact point of each pair of the first discharge roller 55 and the spur 56 may be located at the same or substantially the same positions as the upper ends of the first ribs 51 with respect to the up-down direction 101.

Figure 9:
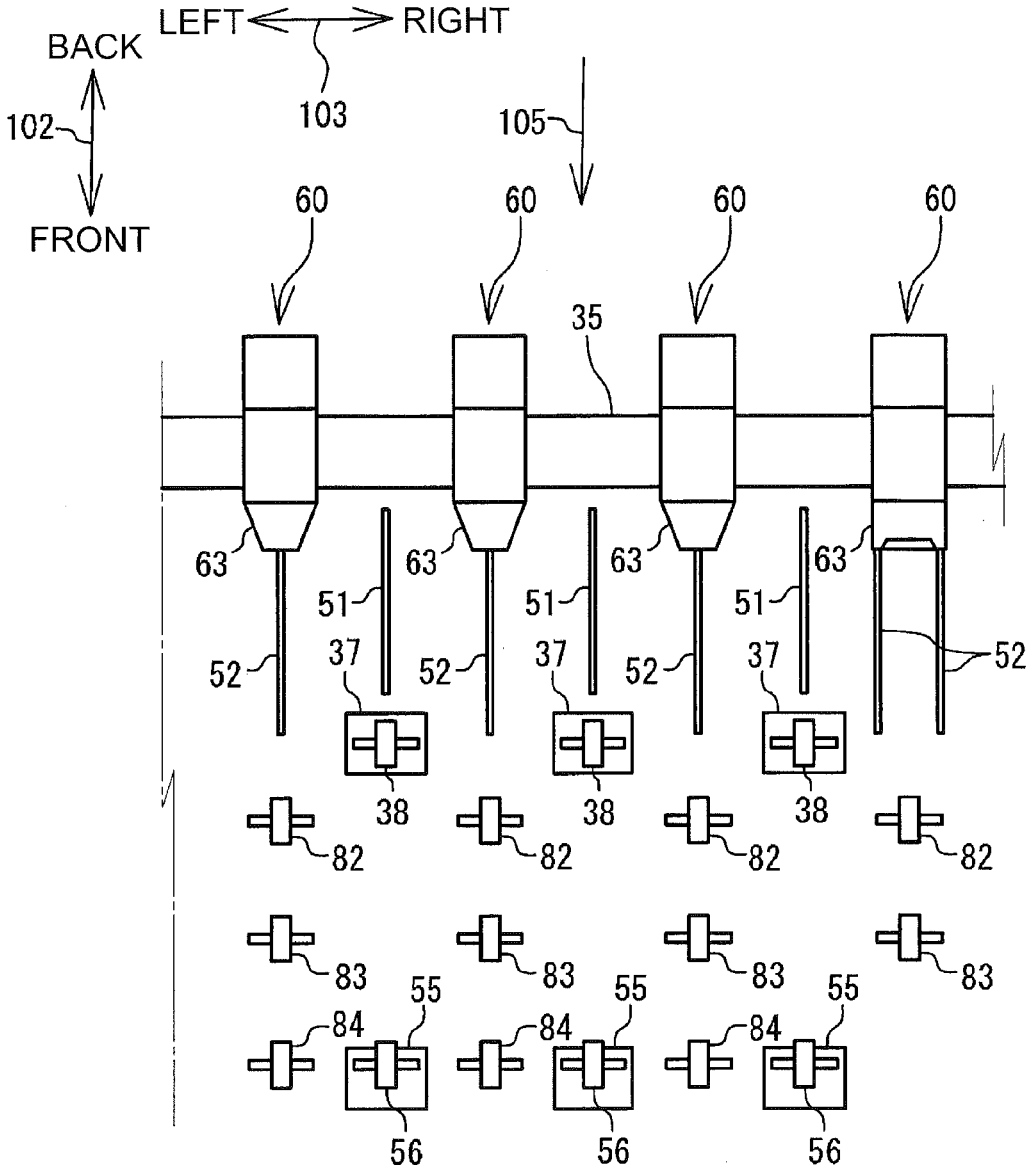
FIG. 9 is a plan view depicting an arrangement of a conveyor roller, the first discharge rollers, the second discharge roller, and the spurs in the illustrative embodiment according to one or more aspects of the disclosure.

As depicted in FIGS. 2, 3, and 9, a plurality of spurs 84 may be disposed downstream of the second discharge rollers 55 in first conveying path 31 with respect to the conveying direction 105. The spurs 84 may be spaced apart from each other in the right-left direction 103. However, no spur 84 may be disposed at a position corresponding to each of the endmost contact members 60 of the plurality of contact members 60 in the right-left direction 103. The spurs 84 may correspond to third upper contact portions. In FIG. 2, the spurs 84 may be disposed at the same position as the spurs 56 with respect to the direction perpendicular to the drawing sheet. Therefore, the spurs 84 are not depicted in FIG. 2.

The spurs 84 may be configured to move in substantially the up-down direction 101. Each of the spurs 84 may be disposed on a shaft (not depicted) that may extend along the right-left direction 103. For example, the shaft of each spur 84 may be a coil spring. With this configuration, each of the spurs 84 may be configured to move in the up-down direction 101 by an amount of elastic deformation of the corresponding shaft. Lowest ends of the spurs 84 may be located at the same or substantially the same positions as the lower surfaces of the contact portions 63 of the contact portions 60, respectively, in the up-down direction 101. Projecting ends of the spurs 84 projecting toward the first conveying path 31 may be located at the same or substantially the same positions as the roller surfaces of the second discharge rollers 55 protruding toward the first conveying path 31 in the front-rear direction 102.

Figure 8:
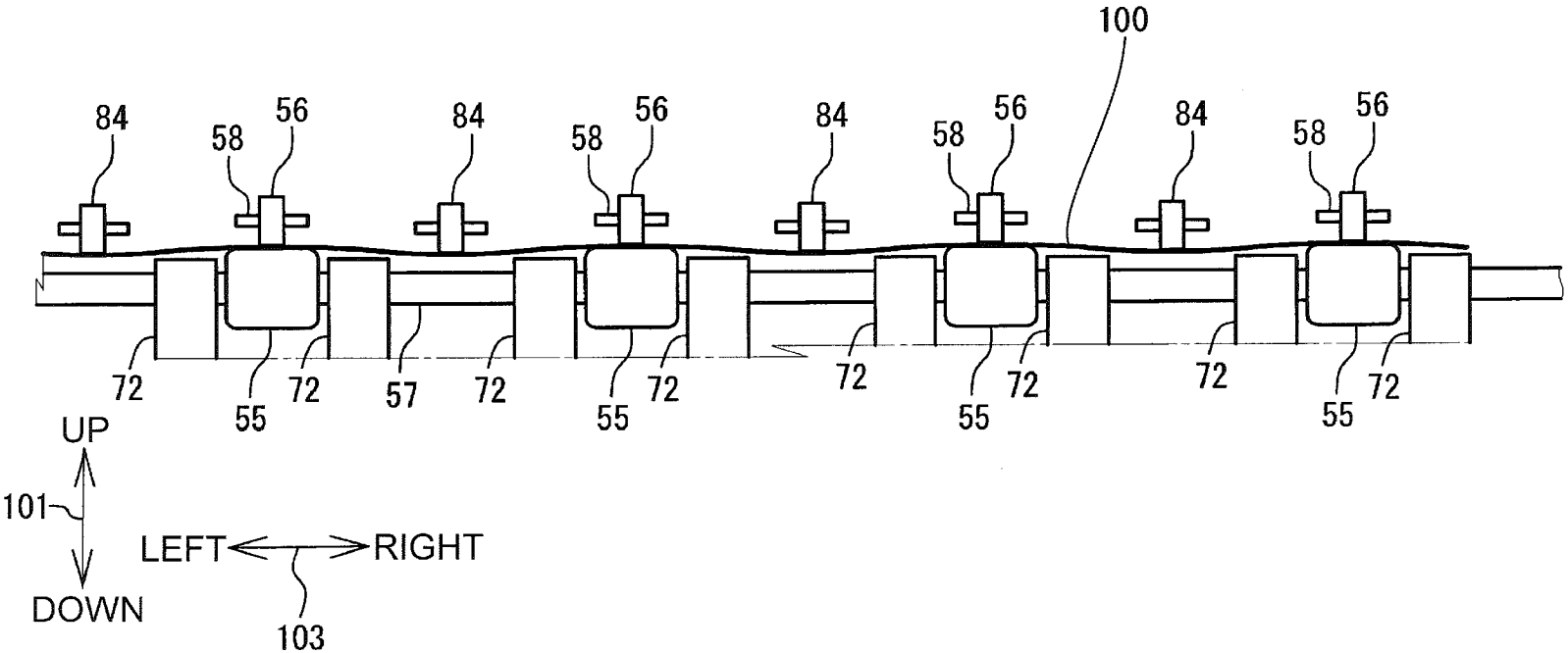
FIG. 8 is a front view depicting second discharge rollers and spurs when the sheet passes between the second discharge rollers and the spurs in the illustrative embodiment according to one or more aspects of the disclosure.

As depicted in FIGS. 2 and 8, a guide portion 72 may be disposed on each side of each second discharge roller 55 in the right-left direction 103. The guide portions 72 may be configured to cover a peripheral surface of the shaft 57 of the second discharge rollers 55. The guide portions 72 may be a part of the defining member 70 constituting a lower guide surface of the second conveying path 32. The guide portions 72 may be engaged with the peripheral surface of the shaft 57. The defining member 70 may be configured to pivot about the shaft 57 when the guide portions 72 turns around the shaft 57. When the defining member 70 pivots, the lower side of the second conveying path 32 may be opened. For example, the defining member 70 may be pivoted when a sheet 100, jammed in the second conveying path 32, is removed.

Peripheral surfaces of the guide portions 72 may be located closer to the peripheral surface of the shaft 57 than the roller surfaces of the second discharge rollers 55. For example, the guide portions 72 might not protrude more outwardly in a radial direction of the shaft 57 than the roller surfaces of the second discharge rollers 55. The peripheral surfaces of the guide portions 72 may be configured to direct a leading edge of a sheet 100 that is to be conveyed to the second discharge rollers 55 in the conveying direction 105 to be nipped between the second discharge rollers 55 and the spurs 56.

As depicted in FIGS. 1 and 2, a sheet discharge tray 23 may be disposed downstream of the second discharge rollers 55 in the conveying direction 105. The sheet discharge tray 23 may be configured to support a sheet 100 discharged from the first conveying path 31. An upper surface of the sheet discharge tray 23 may be configured to support the sheet 100.

The sheet discharge tray 23 may comprise tray members 24, 25, and 26. The tray members 24, 25, and 26 may be united such that the tray members 24, 25, and 26 may be slidable independently. The tray members 24, 25, and 26 may be disposed in this order from upstream in the conveying direction 105. The width along the right-left direction 103 of the tray member 24 that may be disposed at a most-upstream position in the conveying direction 105 may be wider than the width along the right-left direction 103 of the tray member 25 that may be disposed downstream of the tray member 24 in the conveying direction 105. The width along the right-left direction 103 of the tray member 25 may be wider than the width along the right-left direction 103 of the tray member 26 that may be disposed at a most-downstream position in the conveying direction 105. Therefore, the width along the right-left direction 103 of the tray members 24, 25, and 26 may become narrower along the conveying direction 105.

As depicted in FIGS. 1 and 2, the display panel 16 may be disposed on the front of the housing 14. Therefore, the display panel 16 may be located downstream of the second discharge rollers 55 in the conveying direction 105. In addition, the display panel 16 may be disposed above the opening 15 of the housing 14. Therefore, the display panel 16 may be located at a higher position than the second discharge rollers 55 in the up-down direction 101.

As described above, the axes of the shafts 58 of the spurs 56 may be located upstream of the axis of the shaft 57 of the second discharge rollers 55 in the conveying direction 105. Therefore, a tangent line 106 that may pass through the nip position between one second discharge roller 55 and one spur 56 and may be tangent to the roller surface of the second discharge roller 55 may extend obliquely upward in the conveying direction 105. A sheet 100 to be discharged from the first conveying path 31 while being sandwiched between the second discharge rollers 55 and the spurs 56 may be discharged along the tangent line 106 if the sheet 100 is not deformed, e.g., like a rigid body.

However, sheets of various types (including the above-described recording sheet) on which image recording is to be performed by the printer unit 11, may have flexibility such that the sheets may be bent along the curved section of the first conveying path 31. Therefore, the sheets of various types to be discharged from the first conveying path 31 while being sandwiched between the second discharge rollers 55 and the spurs 56 may sag downward from the tangent line 106.

A lower end of the display panel 16 disposed on the front of the housing 14 may be located higher than the tangent line 106. Therefore, the various sheets might not contact the lower end of the display panel 16 when the sheets are discharged from the first conveying path 31.

Figure 5:
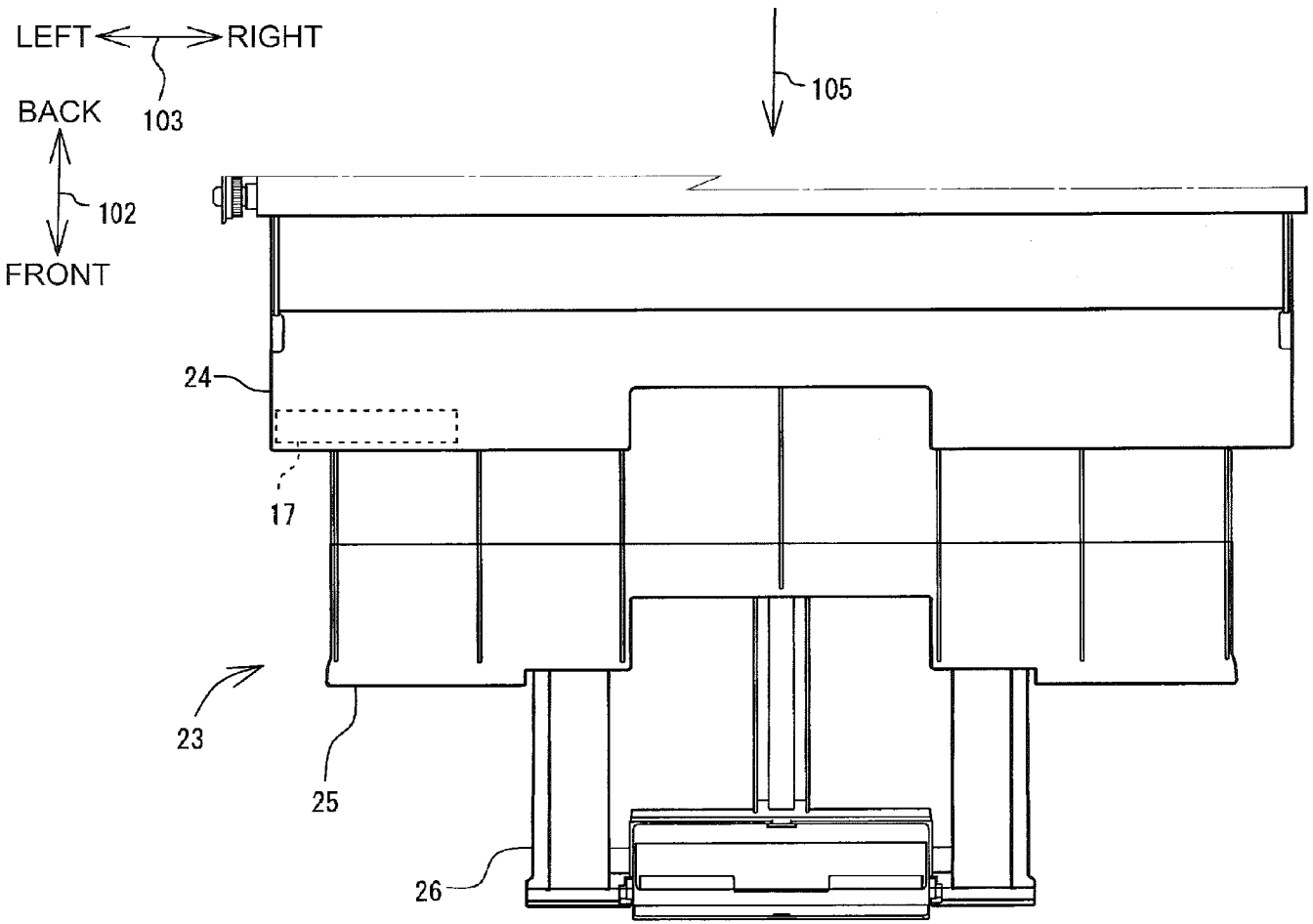
FIG. 5 is a plan view depicting a sheet discharge tray in the illustrative embodiment according to one or more aspects of the disclosure.

In addition, as depicted in FIGS. 1 and 5, the gripping portion 17 (indicated by a dashed line in FIG. 5) may be disposed at the lower end of the display panel 16. The gripping portion 17 may be located outside of both ends of the narrowest tray member 26 in the right-left direction 103 of the sheet discharge tray 23.

Hereinafter, an operation of the image recording apparatus 10 is now described. The printer unit 11 may be configured to operate upon receipt of an instruction of image recording. The feed roller 43, the conveyor roller 35, the first discharge rollers 37, the second discharge rollers 55, and the carriage 48 may be operated at a predetermined timing by which the motor may be driven at a predetermined timing in the printer unit 11.

The feed roller 43 may feed an uppermost sheet of the one or more sheets placed on the sheet feed tray 20 in the sheet feeding direction 104 by the rotation of the feed roller 43. The inclined wall 22 may contact a leading edge of the fed sheet and direct the sheet 100 upward to allow the sheet to enter the first conveying path 31. Then, the leading edge of the sheet 100 entered the first conveying path 31 may reach the conveyor roller 35 and the following rollers 36. At that time, the conveyor roller 35 and the following rollers 36 may nip the leading end of the sheet 100 and then may convey the sheet 100 to a position upstream of the platen 50.

At the position upstream of the platen 50 in the conveying direction 50, the first ribs 51 of the platen 50 may hold the sheet 100 from below and the contact portions 63 of the contact members 60 may press an upper surface of the sheet 100. For example, the first ribs 51 and the contact portions 63 may nip the leading edge of the sheet 100 therebetween.

Figure 6:
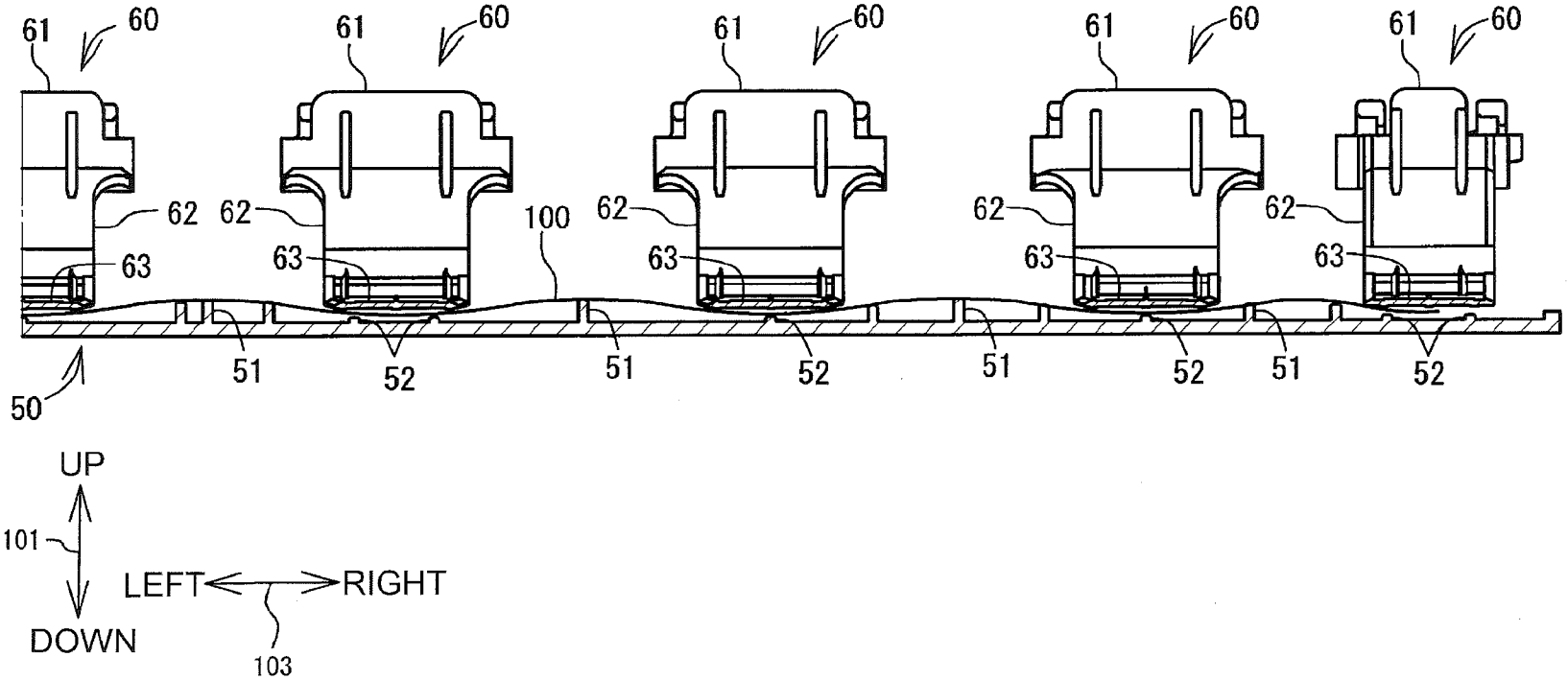
FIG. 6 is a front view depicting contact portions and the platen when a sheet passes between the contact portions and the platen in the illustrative embodiment according to one or more aspects of the disclosure.

As depicted in FIG. 6, the upper ends of the first ribs 51 may be located higher than the lower surfaces of the contact portions 63 of the contact members 60 in the up-down direction 101. In addition, one of the first ribs 51 may be disposed between adjacent ones of the contact portions 60 in the right-left direction 103. The contact portions 60 might not be disposed above any of the first ribs 51 in the up-down direction 101. Therefore, the sheet 100 may be formed into a corrugated shape, in which the sheet 100 may have ridge portions that may be held by the first ribs 51 and groove portions that may be depressed by the contact portions 63. In this embodiment, the sheet 100 may have a maximum width on which the printer unit 11 may be able to perform image recording in the right-left direction 103. Thus, the endmost contact portions 63 in the right-left direction 103 may press side edges of the sheet 100 in the right-left direction 103 from above.

For example, when a sheet 100 having relatively high stiffness, such as a thick paper, is conveyed, the contact portions 63 may be slightly moved upward in the up-down direction 101 when the curved portions 62 of the contact members 60 may be deformed elastically. A deformation amount of the curved portions 62 may be determined such that the lower surfaces of contact portions 63 might not be located at respective positions higher than the upper ends of the first ribs 51 when the curved portions 62 may be deformed elastically.

After the leading edge of the sheet 100 passes below the contact portions 63, the contact portions 63 might not press the groove portions formed in the leading edge of the sheet 100 from above and the first ribs 61 of the platen 50 may hold the ridge portions formed in the leading edge of the sheet 100 held on the platen 50. For example, in the sheet 100 such a recording sheet, the pressing of the sheet 100 by the contact portions 63 to form a corrugated shape in the sheet 100 may have influence on a downstream part of the sheet 100 in the conveying direction 105.

When the leading edge of the sheet 100 reaches under the recording head 46, the conveyor roller 35 may be allowed to stop rotating to stop the conveyance of the sheet 100. While the conveyance of the sheet 100 is stopped, the carriage 48 may be driven to move along the right-left direction 103 and the recording head 47, that may move together with the carriage 48 along the right-left direction 103, may selectively eject ink droplets from the nozzles 47. The ink droplets ejected from the nozzles 47 may be adhered onto the sheet 100. Then, after the conveyor roller 35 may be rotated by a predetermined amount corresponding to a line feed to further convey the sheet 100 in the conveying direction 105. Subsequently, the conveyor roller 35 may be allowed to stop rotating again. The image recording apparatus 10 may record a desired image onto the sheet 100 by alternately performing a line feed and the movement of the recording head 46 (e.g., an intermittent conveyance).

For example, a sheet 100 whose paper grain direction is parallel to the right-left direction 103 may tend to curl along the conveying direction 105 by adhesion of ink droplets. However, the corrugation pattern formed in the sheet 100 in the right-left direction 103 may increase the stiffness of the sheet 100 in the conveying direction 105 and reduce an occurrence of the curling in the sheet 100 when ink droplets are adhered to the sheet 100.

By the intermittent conveyance of the sheet 100, the leading edge of the sheet 100 may pass the platen 50 and then reach the first discharge rollers 37 and the spurs 38. The pairs of first discharge roller 37 and spur 38 may be disposed at respective positions corresponding to the first ribs 51 in the right-left direction 103. Therefore, the pairs of first discharge roller 37 and spur 38 may nip the respective ridge portions formed in the corrugated sheet 100. After that, the first discharge rollers 37 and the spurs 38 may further convey the sheet 100 in the conveying direction 105 by the rotation of the first discharge rollers 37. The rotation of the first discharge rollers 37 may be synchronized with the rotation of the conveyor roller 35.

Figure 7:
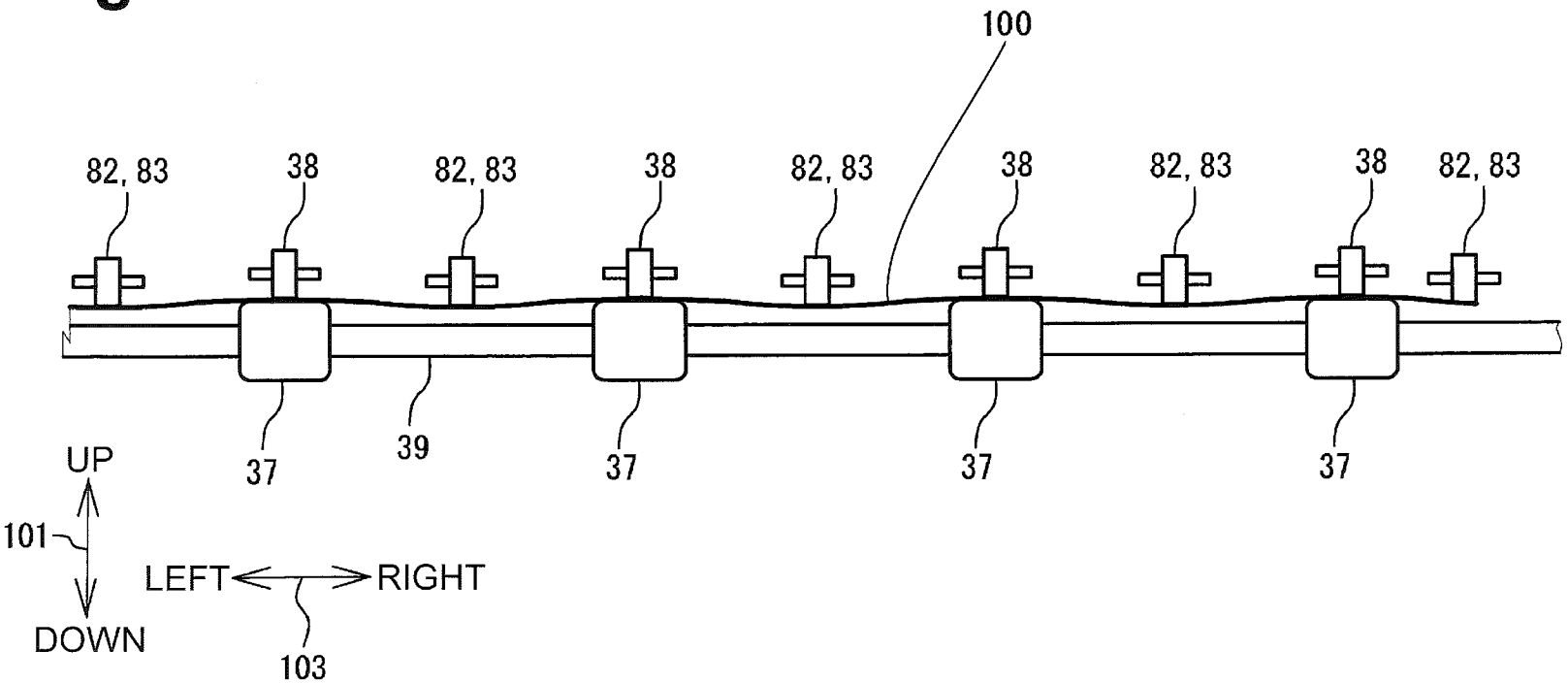
FIG. 7 is a front view depicting first discharge rollers and spurs when the sheet passes between the first discharge rollers and the spurs in the illustrative embodiment according to one or more aspects of the disclosure.

As depicted in FIGS. 7 and 9, lower ends of the spurs 82, 83 may be located lower than the nip points between the first discharge rollers 37 and spurs 38 in the up-down direction 101. One pair of the spur 82 and the spur 83 may be disposed between each pair of the first discharge roller 37 and the spur 38 in the right-left direction 103, and the first discharge rollers 37 and the spurs 38 might not be disposed under any pair of the spur 82 and the spur 83 in the up-down direction 101. With this configuration, the sheet 100 may be formed into the corrugated shape, in which the sheet 100 may have ridge portions that may be nipped by the first discharge rollers 37 and the spurs 38 and groove portions that may be depressed by the spurs 82 and 83. In this embodiment, the sheet 100 may have a maximum width on which the printer unit 11 may be able to perform image recording in the right-left direction 103. Thus, endmost pairs of the spur 82 and the spur 83 may press the side edges of the sheet 100 in the right-left direction 103 from above.

The ridge portions formed in an upstream part of the sheet 100 may be held by the respective first ribs 51 and the groove portions formed in the upstream part of the sheet 100 may be depressed by the respective contact portions 63 in the conveying direction 105. Then, the ridge portions formed in a downstream part of the sheet 100 may be nipped by the first discharge rollers 37 and the spurs 38 and the groove portions formed in the downstream part of the sheet 100 may be depressed by the spurs 82 and 83. Therefore, the sheet 100 may be corrugated on both sides of the platen 50 in the conveying direction 105.

Downstream from spurs 82 and 83 and first discharge rollers 37, the leading edge of the sheet 100 may reach the second discharge rollers 55 and the spurs 56 by which the first discharge rollers 37 and the spurs 38 may further convey the sheet 100 in the conveying direction 105. The second discharge rollers 55 and the spurs 56 may be disposed at the respective positions corresponding to the (e.g., aligned with) respective first ribs 51 in the right-left direction 103. Therefore, the second discharge rollers 55 and the spurs 56 may nip the ridge portions of the corrugated sheet 100. Subsequently, the second discharge rollers 55 and the spurs 56 may further convey the sheet 100 in the conveying direction 105 by the rotation of the second discharge rollers 55. The rotation of the second discharge rollers 55 may be synchronized with the rotation of the conveyor roller 35.

As depicted in FIGS. 8 and 9, lower ends of the spurs 84 may be located lower than the nip points between the second discharge rollers 55 and the spurs 56 in the up-down direction 101. Additionally, one spur 84 may be disposed between each pair of the second discharge roller 37 and the spur 38 in the right-left direction 103, and the second discharge rollers 55 and the spurs 56 might not be disposed under any spur 84 in the up-down direction 101. The upper guide surfaces of the guide portions 72 may be located lower than the nip points between the second discharge rollers 55 and the spurs 56 in the up-down direction 101. Therefore, the sheet 100 may be formed into the corrugated shape (or the corrugated shape of the sheet 100 may be maintained), in which the sheet 100 may have ridge portions that may be nipped by the second discharge rollers 55 and the spurs 56 and groove portions that may be depressed by the spurs 84 and may be guided upward by the guide portions 72 such that the groove portions might not come into contact with the shaft 57.

In this embodiment, the sheet 100 may have a maximum width on which the printer unit 11 may be able to perform image recording in the right-left direction 103. The spurs 84 might not be disposed at the respective positions facing both side edges of the maximum-sized sheet 100 in the right-left direction 103. Therefore, the groove portions formed on the both side edges of the sheet 100 in the right-left direction 103 may be guided by the guide portions 72 to prevent the sheet 100 from contacting the shaft 57 and might not be pressed by the spurs 84.

The ridge portions of the sheet 100 may be nipped by the second discharge rollers 55 and the spurs 56 and the groove portions of the sheet 100 may be depressed by the spurs 84 from above. Therefore, the sheet 100 may be formed into a corrugated shape. The axes of the shafts 58 of the spurs 56 may be located upstream of the axis of the shaft 57 of the second discharge rollers 55. Therefore, the second discharge rollers 55 and the spurs 56 may discharge the sheet 100 onto the sheet discharge tray 23 along the tangent line 106 by nipping the sheet 100 therebetween.

The both ends of the tray members 25 and 26 in the right-left direction 103 may be located closer to the center line of the sheet discharge tray 23 than the both side edges of the sheet 100 in the right-left direction 103. Therefore, both ends of the tray members 25 and 26 might not contact with the both side edges of the sheet 100 in the right-left direction 103. Further, the second discharge rollers 56 and the spurs 55 may discharge the corrugated sheet 100 obliquely upward along the tangent line 106. Thus, the leading edge of sheet 100 might not sag downward toward the tray member 24 until a most part of the sheet 100 passes through the nip points between the second discharge rollers 56 and the spurs 55. Therefore, the tray member 24 might not contact the both side edges of the sheet in the right-left direction 103.

When the inkjet recording apparatus 10 performs double-sided printing, the second discharge rollers 55 may be stopped (e.g., temporarily) immediately before the trailing edge of the sheet 100 (and after the trailing edge of the sheet 100 has passed the spurs 82 and 83), on which an image has been recorded on a first surface of the sheet 100, passes the nip points between the second discharge rollers 55 and the spurs 56. Then, the second discharge rollers 55 may be rotated in the reverse direction. Thus, the sheet 100 may be conveyed in a direction opposite to the conveying direction 105 and enter the second conveying path 32 from the first conveying path 31. In other embodiments, for example, a guide flap may be disposed on a junction of the first conveying path 31 and the second conveying path 32. The guide flap may be configured to guide the sheet 100 smoothly to the second conveying path 32 from the first conveying path 31.

The sheet 100 that enters the second conveying path 32 may enter again the curved section of the first conveying path 31 while the first surface on which the image has been recorded is curved inward. Then, the image recording apparatus 10 may record an image on a second surface of the sheet 100 in a similar manner that the image recording apparatus 10 records an image on the first surface of the sheet 100.

According to the illustrative embodiment, no spur 84 may be disposed at the positions corresponding to the endmost ones of the contact members 60 in the right-left direction 103. Therefore, the groove portions of the both side edges of corrugated sheet 100 in the right-left direction 103 might not be depressed downward by the spurs 84. Thus, an occurrence the side edges of the corrugated sheet 100 being caught on a holding surface of the sheet discharge tray 23 or the corrugated sheet 100 pushing the sheet 100 held on the sheet discharge tray 23 out of the sheet discharge tray 23 may be reduced.

According to the illustrative embodiment, the axes of the shafts 58 of the spurs 56 may be located upstream of the axis of the shaft 57 of the second discharge rollers 55. Therefore, the second discharge rollers 56 and the spurs 55 may discharge the sheet 100 onto the sheet discharge tray 23 along the tangent line 106 by nipping the sheet 100 therebetween. Thus, an occurrence of a problem that the leading edge of the sheet 100 may be caught on the holding surface of the sheet discharge tray 23 may be reduced.

According to the illustrative embodiment, the guide portions 72 may be disposed outside of both endmost rollers of the second discharge rollers 55 in the right-left direction 103 and may cover the shaft 57. Thus, the groove portions of the side edges of the corrugated sheet 100 in the right-left direction 103 may be smoothly guided to the nip points between the second discharge rollers 55 and the spurs 56 by the guide portions 72.

According to the illustrative embodiment, the width of the sheet discharge tray 23 in the right-left direction 103 may become narrower along the conveying direction 105. Therefore, the sheet discharge tray 23 may be configured to hold the sheet 100 while the holding surface of the sheet discharge tray 23 is not present at positions corresponding to the side edges of a downstream end of the corrugated sheet 100. This configuration may reduce an occurrence of floating of the sheet 100 from the holding surface of the sheet discharge tray 23. Therefore, the sheet discharge tray 23 may hold a large number of sheets 100.

According to the illustrative embodiment, the lower end of the display panel 16 may be located higher than the tangent line 106. Thus, an occurrence a problem that the leading edge of the sheet 100 being discharged and nipped by the second discharge rollers 56 and the spurs 55 may come into contact with the display panel 16 may be reduced.

According to the illustrative embodiment, the grip portion 17 of the display panel 16 may be located outside of the both ends of the tray member 26 in the right-left direction 103. Thus, a user can operate the grip portion 17 without interfere in the sheets 100, although a sheet 100 having a width smaller than the width of the tray member 26 may be held by the feed discharge tray 23, a user can without interfering with the sheet 100.

A variation of the illustrative embodiment is now described. In the above-described illustrative embodiment, a straight section of the first conveying path 31 may extend along the front-rear direction 120 and the right-left direction 103 and substantially perpendicular to the up-down direction 101. Therefore, the positional relationship between the upper ends of the first ribs 51 and the upper ends of the second ribs 52 of the platen 50 and the positional relationship between the upper ends of the first ribs 51 and the lower surfaces of the contact portions 63 of the contact members 60 may be described with the word "higher" or "lower" with respect to the up-down direction. The area in which the platen 50, the contact members 60, the first discharge rollers 37, the spurs 38, 56, 82, 83, 84, and the second discharge rollers 55 may be disposed in the first conveying path 31 might not necessarily extend perpendicularly to the up-down direction. For example, the first conveying path 31 may extend obliquely upward or obliquely downward. In this case, the positional relationship between the upper ends of the first ribs 51 and the upper ends of the second ribs 52 of the platen 50 and the positional relationship between the upper ends of the first ribs 51 and the lower surfaces of the contact portions 63 of the contact members 60 may be described according to various directional relationships depending on the configuration (e.g., direction, angle, etc.) of the first conveying path 31.

In the above-described illustrative embodiment, the recording head 46 may be mounted on the carriage 48 and configured to move in the right-left direction 103. Nevertheless, in other embodiments, for example, a recording head may have nozzle rows defined across an area that may correspond to the width of the sheet 100 in the right-left direction 103 and be configured to eject ink droplets across the width of the sheet 100 in the right-left direction 103 without mount in the right-left direction 103.

Although specific examples of carrying out the invention have been described, those skilled in the art will appreciate that there are numerous variations and permutations of the above-described systems and methods that are contained within the spirit and scope of the invention as set forth in the appended claims. Additionally, numerous other embodiments, modifications and variations within the scope and spirit of the appended claims will occur to persons of ordinary skill in the art from a review of this disclosure.

What is claimed is:

1. An image recording apparatus comprising:

a platen configured to receive a sheet conveyed in a conveying direction;

a recording head configured to eject ink droplets from nozzles onto the sheet held by the platen;

a plurality of first upper contact portions disposed upstream of the nozzles with respect to the conveying direction and spaced apart from each other with respect to a width direction orthogonal to the conveying direction, and wherein the plurality of upper contact portions are configured to contact an upper surface of the sheet;

a first lower contact portion disposed between a pair of first upper contact portions of the plurality of first contact upper portions with respect to the width direction, and wherein the first lower contact portion is configured to contact a lower surface of the sheet to form a corrugated shape in the sheet in conjunction with the plurality of first contact portions;

a plurality of second upper contact portions disposed downstream of the nozzles with respect to the conveying direction and spaced apart from each other with respect to the width direction, and wherein the plurality of second upper contact portions are configured to contact the upper surface of the sheet;

a second lower contact portion disposed downstream of the recording head with respect to the conveying direction and between a pair of second upper contact portions with respect to the width direction, wherein the second lower contact portion is configured to contact the lower surface of the sheet to form a corrugated shape in the sheet in conjunction with the plurality of second upper contact portions;

a plurality of third upper contact portions disposed downstream of the second lower contact portion and the plurality of second upper contact portions with respect to the conveying direction and spaced apart from each other with respect to the width direction, wherein the plurality of third upper contact portions are configured to contact the upper surface of the sheet;

a third lower contact portion disposed downstream of the second lower contact portion and the plurality of second upper contact portions with respect to the conveying direction and between a pair of third upper contact portions with respect to the width direction, wherein the third lower contact portion is configured to contact the lower surface of the sheet to form a corrugated shape in the sheet in conjunction with the plurality of third upper contact portions, the third lower contact portion comprising a drive roller disposed below a following roller; and a guide member disposed outside of each side of the drive roller with respect to the width direction, the guide member configured to guide the sheet to a nip point of the drive roller and the following roller and to rotate about a shaft of the drive roller, wherein the image recording apparatus further comprises a defining member configured to define a part of a conveying path, wherein the guide member is a part of the defining member, and wherein none of the plurality of third upper contact portions is disposed at a position, with respect to the width direction, corresponding to each endmost first upper contact portion of the plurality of first upper contact portions with respect to the width direction.

2. The image recording apparatus according to claim 1, wherein an axis of the following roller is located upstream of an axis of the drive roller with respect to the conveying direction.

3. The image recording apparatus according to claim 1, wherein the drive roller extends further toward a sheet conveying path than the guide member.

4. The image recording apparatus according to claim 1, further comprising a sheet discharge tray, wherein a width of the sheet discharge tray with respect to the width direction narrows toward the conveying direction.

5. The image recording apparatus according to claim 4, further comprising a display panel having a grip portion, wherein the display panel is disposed downstream of the third lower contact portion with respect to the conveying direction, and wherein the display panel is configured to pivot about an axis provided at its upper end, and wherein the grip portion is disposed on a lower end of display panel and located outside of both ends of a narrowest part of the sheet discharge tray with respect to width direction.

6. The image recording apparatus according to claim 1, further comprising a display panel disposed downstream of the third lower contact portion with respect to the conveying direction and located higher than a nip point between a first nipping member of the third lower contact portion and a second nipping member, and wherein a lower end of the display panel is located higher than a tangent line that passes through the nip point between the first and second nipping members.

7. The image recording apparatus according to claim 1, wherein the plurality of second upper contact portions are disposed downstream of a nip point between a first nipping member of the second lower contact portion and a second nipping member with respect to the conveying direction.

8. The image recording apparatus according to claim 1, wherein a portion of the plurality of first upper contact portions extends into a sheet conveying path overlaps, in the width direction, with a portion of the first lower contact portion extending into the sheet conveying path, wherein a first nipping member of the second lower contact portion and a second nipping member are configured to nip the sheet at a first nip point, wherein a third nipping member of the third lower contact portion and a fourth nipping member are configured to nip the sheet at a second nip point, wherein a portion of the plurality of second upper contact portions extends into the sheet conveying path past the first nip point in a direction orthogonal to the sheet conveying path, and wherein a portion the plurality of third upper contact portions extends into the sheet conveying path past the second nip point in a direction orthogonal to the sheet conveying path.

9. The image recording apparatus according to claim 1, wherein sheet contact ends of the plurality of third upper contact portions are located at substantially the same position as a sheet contact end of the following roller with respect to the conveying direction.

10. The image recording apparatus according to claim 1, wherein the image recording apparatus defines a main conveying path and a reverse conveying path, and wherein the third upper contact portions and the third lower contact portion are disposed downstream of the reverse conveying path in the conveying direction.

11. The image recording apparatus according to claim 1, wherein the second and third upper contact portions comprise spur rollers, wherein each of the second upper contact portions are disposed at a respective position corresponding to a respective one of the plurality of first contact portions with respect to the conveying direction, and wherein each of the third upper contact portions are disposed at a respective position corresponding to a respective one of the plurality of first contact portions with respect to the conveying direction.

12. An image recording apparatus comprising:

a platen configured to receive a sheet conveyed in a conveying direction;

a recording head configured to eject ink droplets from nozzles onto the sheet held by the platen;

a plurality of first upper contact portions disposed upstream of the nozzles with respect to the conveying direction and spaced apart from each other with respect to a width direction orthogonal to the conveying direction, and wherein the plurality of upper contact portions are configured to contact an upper surface of the sheet;

a first lower contact portion disposed between a pair of first upper contact portions of the plurality of first contact portions with respect to the width direction, and wherein the first lower contact portion is configured to contact a lower surface of the sheet to form a corrugated shape in the sheet in conjunction with the plurality of first contact portions;

a plurality of second upper contact portions disposed downstream of the nozzles with respect to the conveying direction and spaced apart from each other with respect to the width direction, and wherein the plurality of second upper contact portions are configured to contact the upper surface of the sheet;

a second lower contact portion disposed downstream of the recording head with respect to the conveying direction and between a pair of second upper contact portions with respect to the width direction, wherein the second lower contact portion is configured to contact the lower surface of the sheet to form a corrugated shape in the sheet in conjunction with the plurality of second upper contact portions;

a plurality of third upper contact portions disposed downstream of the second lower contact portion and the plurality of second upper contact portions with respect to the conveying direction and spaced apart from each other with respect to the width direction, wherein the plurality of third upper contact portions are configured to contact the upper surface of the sheet;

a third lower contact portion disposed downstream of the second lower contact portion and the plurality of second upper contact portions with respect to the conveying direction and between a pair of third upper contact portions with respect to the width direction, wherein the third lower contact portion is configured to contact the lower surface of the sheet to form a corrugated shape in the sheet in conjunction with the plurality of third upper contact portions, the third lower contact portion comprising a drive roller disposed below a following roller; and a guide member disposed outside of each side of the drive roller with respect to the width direction, the guide member configured to guide the sheet to a nip point of the drive roller and the following roller and to rotate about a shaft of the drive roller, wherein the image recording apparatus further comprises a defining member configured to define a part of a conveying path, and wherein the guide member is a part of the defining member.

13. The image recording apparatus according to claim 12, wherein the image recording apparatus further defines a reverse conveying path, and wherein the third upper contact portions and the third lower contact portion are disposed downstream of the reverse conveying path in the conveying direction.

* * * * *